US007176862B2

(12) United States Patent
Baek

(10) Patent No.: US 7,176,862 B2
(45) Date of Patent: Feb. 13, 2007

(54) GAMMA REFERENCE VOLTAGE GENERATING CIRCUIT AND A METHOD OF USING THE SAME IN A LIQUID CRYSTAL DISPLAY

(75) Inventor: Heume Il Baek, Seoul (KR)

(73) Assignee: LG.Philips LCD Co, Ltd, Seoul (KR)

( * ) Notice: Subject to any disclaimer, the term of this patent is extended or adjusted under 35 U.S.C. 154(b) by 271 days.

(21) Appl. No.: 10/091,116

(22) Filed: Mar. 6, 2002

(65) Prior Publication Data

US 2002/0126077 A1 Sep. 12, 2002

(30) Foreign Application Priority Data

Mar. 7, 2001 (KR) ..... 10-2001-0011776

(51) Int. Cl.
*G09G 3/36* (2006.01)

(52) U.S. Cl. ..... 345/87; 345/88; 345/89

(58) Field of Classification Search ..... 345/87–89, 345/94, 98–100, 102, 204, 208, 211, 213
See application file for complete search history.

(56) References Cited

U.S. PATENT DOCUMENTS 5,640,174 A * 6/1997 Kamei et al. ..... 345/89
5,854,627 A * 12/1998 Kurihara et al. ..... 345/211
6,462,724 B1 * 10/2002 Ozawa et al. ..... 345/87

FOREIGN PATENT DOCUMENTS

| | | |
|---|---|---|
| JP | 2000-193936 | 7/2000 |
| KR | 1999-017665 | 3/1999 |

* cited by examiner

*Primary Examiner*—Jimmy H. Nguyen
(74) *Attorney, Agent, or Firm*—Morgan, Lewis & Bockius, LLP

(57) ABSTRACT

A gamma reference voltage generating circuit in a liquid crystal display includes a first gamma power unit outputting a first gamma voltage for a reflective driving mode of the liquid crystal display, a second gamma power unit outputting a second gamma voltage for a transmissive driving mode of the liquid crystal display, and a switching unit selecting one of the first gamma voltage of the first gamma power unit and the second gamma voltage of the second gamma power unit, and outputting the selected gamma voltage to a source driving circuit.

12 Claims, 6 Drawing Sheets

GAMMA REFERENCE VOLTAGE GENERATING CIRCUIT AND A METHOD OF USING THE SAME IN A LIQUID CRYSTAL DISPLAY

This application claims the benefit of Korean Patent Application No. P2001-11776 filed in Korea on Mar. 7, 2001, which is hereby incorporated by reference.

BACKGROUND OF THE INVENTION

1. Field of the Invention

The present invention relates to a display device, and more particularly, to a gamma reference voltage generating circuit and a method of using a gamma reference voltage generating circuit in a liquid crystal display. Although the present invention is suitable for a wide scope of applications, it is particularly suitable for obtaining an optimized luminance in a transmissive mode and a reflective mode.

2. Discussion of the Related Art

A gamma reference voltage generating circuit of a liquid crystal display is an essential element of the liquid crystal display that influences picture quality. The gamma reference voltage generating circuit generates and outputs a reference voltage required for digital/analog conversion in a source driving circuit.

FIG. 1 illustrates the structure of a liquid crystal display device according to the related art. In FIG. 1, the liquid crystal display device includes a liquid crystal display 11, a gate driving circuit 12, a source driving circuit 13, and a gamma reference voltage generator 14. The liquid crystal display panel 11 includes a plurality of gate lines arranged at fixed intervals along a first direction, and a plurality of data lines arranged at fixed intervals along a second direction orthogonal to the gate lines, thereby forming a pixel region in a matrix array. The gate driving circuit 12 outputs a pulse signal, which sequentially scans pixels of the liquid crystal display panel 11 column by column. The source driving circuit 13 converts externally input red (R), green (G), and blue (B) digital video signals into analog signals, and outputs the converted video signals to each of the plurality of data lines. In order to convert the R, G, and B digital video signals into analog signals, a digital/analog conversion is performed using a reference voltage output from the gamma reference voltage generator 14, thereby generating a liquid crystal driving voltage. The generated liquid crystal driving voltage is applied to the plurality of data lines of the liquid crystal display panel during each scan.

The gamma reference voltage generator 14 serially connects a plurality of resistors between a power terminal Vdd and a ground terminal, thereby supplying a divided voltage. Furthermore, the gamma reference voltage generator 14 generates and outputs the reference voltage necessary for converting the digital video signals at the source driving circuit 13.

FIG. 2 shows a block diagram of a source driving circuit according to the related art. In FIG. 2, the source driving circuit includes a shift register 1 outputting a latch clock signal, a first latch unit 2 respectively latching R, G, and B digital video data signals, which are sequentially synchronized with clock signals of a timing controller (not shown), and converting a timing system signal of a dot-at-a-time scanning into a line-at-a-time scanning in accordance with the latch clock signal output from the shift register 1, a second latch unit 3 latching data stored in the first latch unit 2 at every horizontal line cycle in accordance with a transfer enable signal, a digital/analog converter 4 converting the data latched by the second latching unit 3 into analog signals in accordance with the gamma reference voltage, and a buffer 5 buffering the analog signals output from the digital/analog converter 4 and outputting the signals to each data line.

Since the picture quality of the liquid crystal display is highly dependent upon the gamma reference voltage, the gamma reference voltage should be determined based on the electro-optical characteristics of the liquid crystal display panel. A liquid crystal display may be classified, based upon the backlight device used, into a transmissive mode, a semi-transmissive mode, and a reflective mode. The semi-transmissive mode of the liquid crystal display may perform either of two different driving modes depending on the operating conditions. More specifically, a first driving mode includes the reflective mode using a peripheral light source, and a second driving mode includes the transmissive mode using a backlight source. However, due to differences in transmission and reflection characteristic curves of the two driving modes, luminance of the liquid crystal display may vary depending on external conditions, thereby deteriorating picture quality.

FIG. 3 shows a luminance curve of the transmissive mode and the reflective mode according to the related art. In FIG. 3, the luminance value of the transmissive and the reflective modes may be explained by using the following equations:

$$L^*=116(Y/Y_{MAX})^{1/3}-16$$

for $$Y/Y_{MAX}>0.008856$$

$$L^*=903.3(Y/Y_{MAX})$$

for $$Y/Y_{MAX}\leq 0.008856$$

where L* represents the luminance value considered the human visual characteristic, Y represents the luminance value at gray scales, and $Y_{MAX}$ represents the maximum luminance value.

The gamma reference voltage is determined by generating a gray voltage in accordance with the maximum luminance value $Y_{MAX}$. More specifically, as shown in FIG. 3, when using the source driving circuit that displays 64 gray scales, the difference in $L_T$ values between each gray scale is about 1.25 ((100-20)/64) in the transmissive mode and about 1.0937 ((100-30)/64) in the reflective mode. Therefore, a middle gray scales (i.e., 32 gray scales) can be described by using the following equations:

$$L_T(X)=1.25\times X+20$$

$$L_R(X)=1.0937\times X+30$$

where X is the number of gray scales.

The $L_T$ value is about 60 in the transmissive mode, and the $L_R$ value is about 64.9 in the reflective mode. In such cases, as shown in FIG. 3, the driving voltage is 2.2V in the transmissive mode and 2.35V in the reflective mode. Accordingly, a difference in driving voltage occurs between the transmissive mode and the reflective mode in an identical gray scale, which is the middle gray in this case. Therefore, when the transmissive mode and the reflective mode are operated with the same gamma voltage circuit, differences occur in the gray scale that is actually realized.

Accordingly, the gamma reference voltage circuit of a liquid crystal display according to the related art has the following disadvantages. When determining a gamma reference voltage according to a difference in luminance in the reflective mode and the transmissive mode, either a compensated value of the two curves or a design value of a compensating film used in designing the panel was modified. However, such solutions are insufficient for determining the gamma reference voltage value in the liquid crystal display panel.

SUMMARY OF THE INVENTION

Accordingly, the present invention is directed to a gamma reference voltage generating circuit in a liquid crystal display that substantially obviates one or more problems due to limitations and disadvantages of the related art.

An object of the present invention is to provide a gamma reference voltage generating circuit and a method of using a gamma reference voltage generating circuit in a liquid crystal display that determines a gamma reference voltage by applying the luminance of both a transmissive mode and a reflective mode.

Another object of the present invention is to provide a gamma reference voltage generating circuit and a method of using a gamma reference voltage generating circuit in a liquid crystal display to enhance the picture quality of the liquid crystal display.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these objects and other advantages with the purpose of the present invention, as embodied and broadly described, a gamma reference voltage generating circuit in a liquid crystal display includes a first gamma power unit outputting a first gamma voltage for a reflective driving mode of the liquid crystal display, a second gamma power unit outputting a second gamma voltage for a transmissive driving mode of the liquid crystal display, and a switching unit selecting one of the first gamma voltage of the first gamma power unit and the second gamma voltage of the second gamma power unit, and outputting the selected gamma voltage to a source driving circuit.

In another aspect of the present invention, a gamma reference voltage generating circuit in a liquid crystal display includes a DC/DC converter generating a first power $V_{DD1}$ and a second power $V_{DD2}$ for one of a reflective driving mode and a transmissive driving mode, a switching unit selecting and outputting one of the first power and the second power, a first gamma power unit inputting the first power from the switching unit and outputting a first gamma power, a second gamma power unit inputting the second power from the switching unit and outputting a second gamma power, a first common power unit inputting the first power from the switching unit and outputting a first common voltage; and a second common power unit inputting the second power from the switching unit and outputting a second common voltage.

In another aspect, a liquid crystal display device includes a liquid crystal display panel, a source driving circuit connected to the liquid crystal display panel, a gate driving circuit connected to the liquid crystal display panel, a first output unit producing a first voltage during a reflective driving mode of the liquid crystal display panel, a second output unit producing a second voltage during a transmissive driving mode of the liquid crystal display panel, and a switching unit selecting one of the first and second voltages, and outputting the selected voltage to the source driving circuit.

In another aspect, a method for generating a reference voltage for digital/analog conversion in a source driving circuit of a liquid crystal display device includes providing a first voltage during a reflective driving mode of the liquid crystal display device, providing a second voltage during a transmissive driving mode of the liquid crystal display, selecting one of the first and second voltages, and providing the selected voltage to the source driving circuit.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to similar parts.

Figure 1:
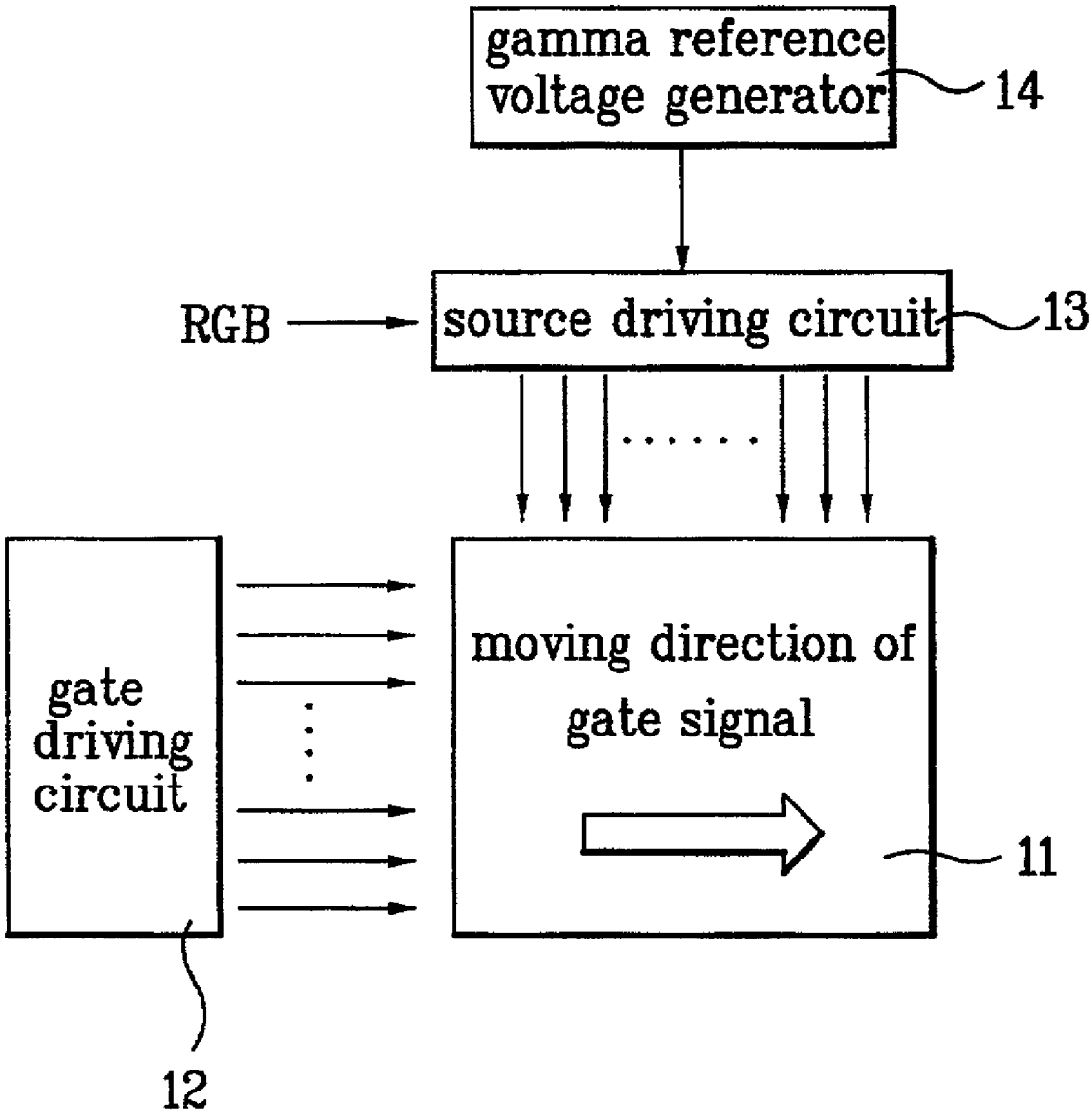
FIG.1 Related Art
FIG. 1 shows a liquid crystal display according to the related art.
Figure 2:
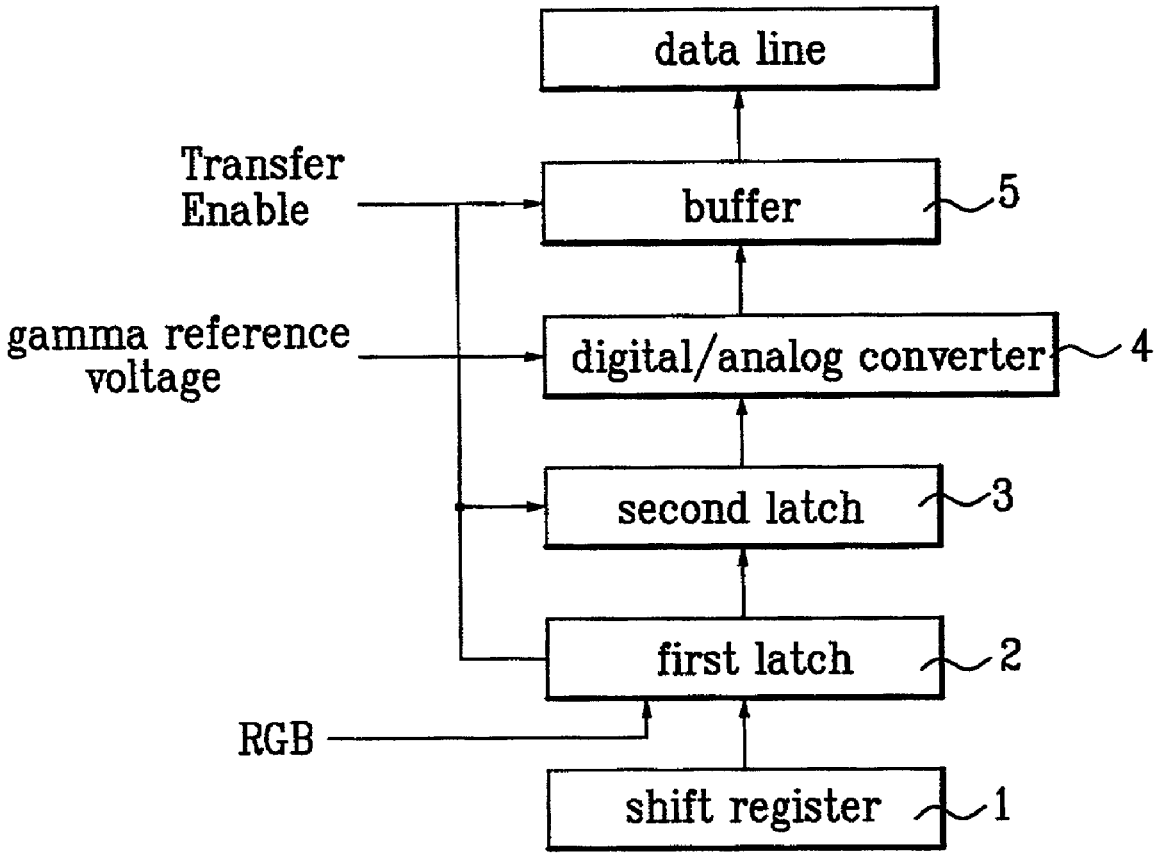
FIG.2 Related Art
FIG. 2 shows a detailed block diagram of a source driving circuit according to the related art.
Figure 3:
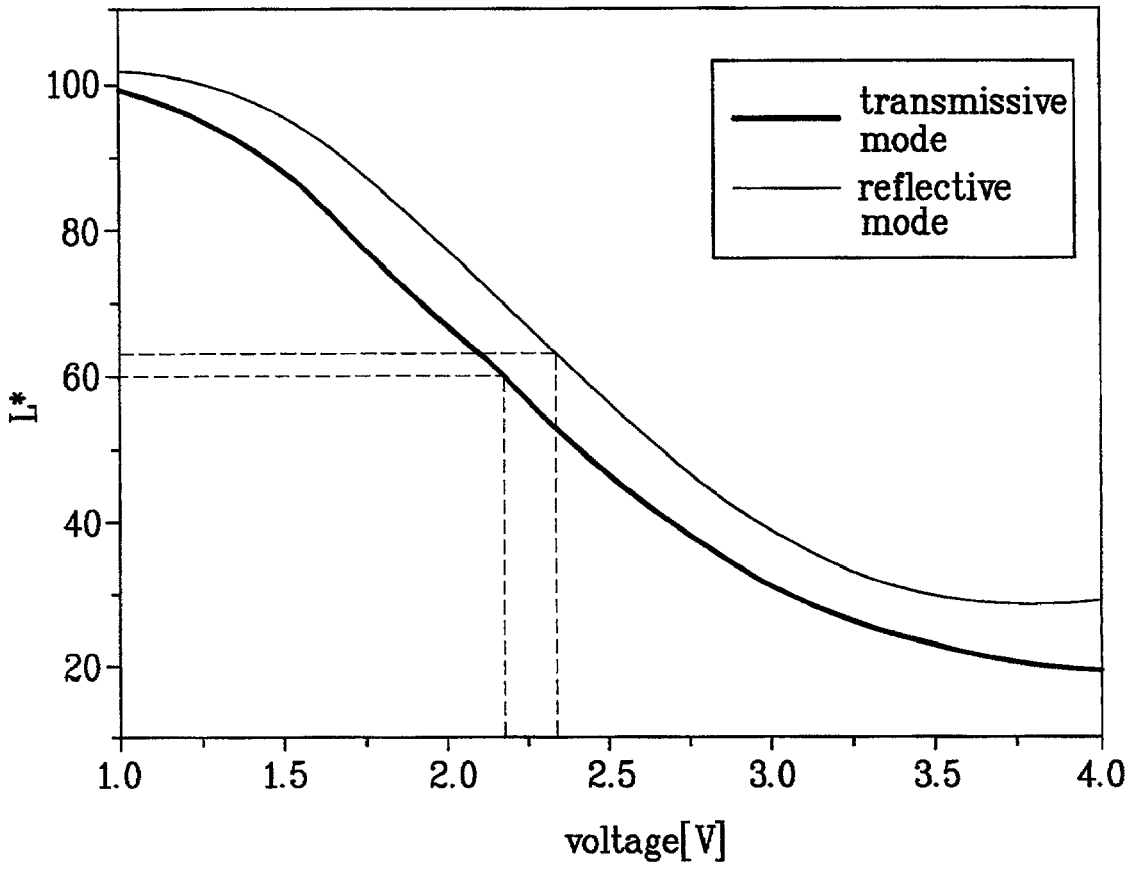
FIG.3 Related Art
FIG. 3 shows luminance curves according to the transmissive mode and the reflective mode of a liquid crystal display according to the related art.
Figure 4:
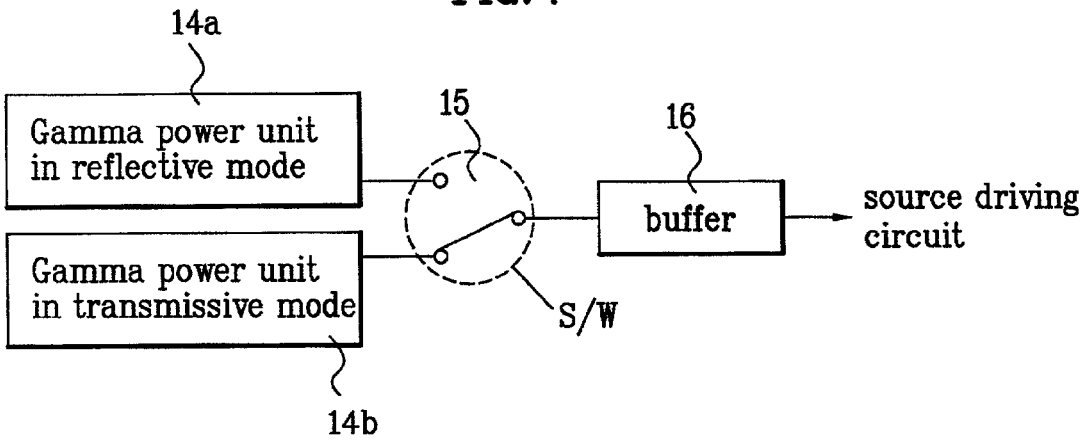
FIG. 4 illustrates an exemplary gamma reference voltage generating circuit of a liquid crystal display according to the present invention.

FIG. 4 illustrates an exemplary gamma reference voltage generating circuit of a liquid crystal display according to the present invention that drives reflective and transmissive modes with different driving voltages. In FIG. 4, the gamma reference voltage generating circuit may include a first gamma power unit 14*a* providing a gamma power in the reflective mode, a second gamma power unit 14*b* providing a gamma power in the transmissive mode, a switching unit 15 selecting an output voltage of the first and second gamma power units 14*a* and 14*b*, and a buffer 16 buffering power output from the switching unit 15 and outputting the buffered power to the source driving circuit. The first gamma power unit 14*a* and the second gamma power unit 14*b* may each be formed of a different divided voltage resistance, or power voltage Vdd.

The gamma reference voltage generating circuit may operate the source driving circuit by selecting the first gamma power unit 14*a* when using the reflective mode only, which uses natural light from an external environment, and by selecting the second gamma power unit 14*b* when using the transmissive mode, which requires a backlight source. The switching unit 15 may be controlled by being synchronized with an ON/OFF switch of the backlight source. The switching unit 15 may select the second gamma power unit 14*b* when the backlight source is turned ON, and the first gamma power unit 14*a* may be selected when the backlight source is turned OFF. The gamma power suitable for the corresponding mode is supplied to the source driving circuit, thereby each driving mode provides optimum luminance.

The gamma reference voltage generating circuit can be designed as shown in FIG. 4 for compensating only a gamma driving voltage range of the reflective mode and the transmissive mode. However, to further optimize the luminance the common voltage may be compensated in alternation with the gamma voltage.

Figure 5A:
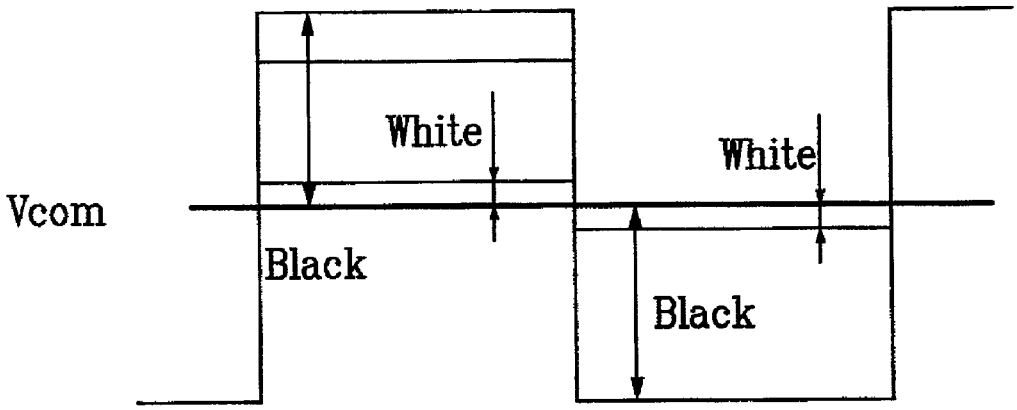
FIGS. 5A and 5B illustrate a signal diagram of a driving voltage range in an exemplary liquid crystal display according to the present invention.
Figure 5B:
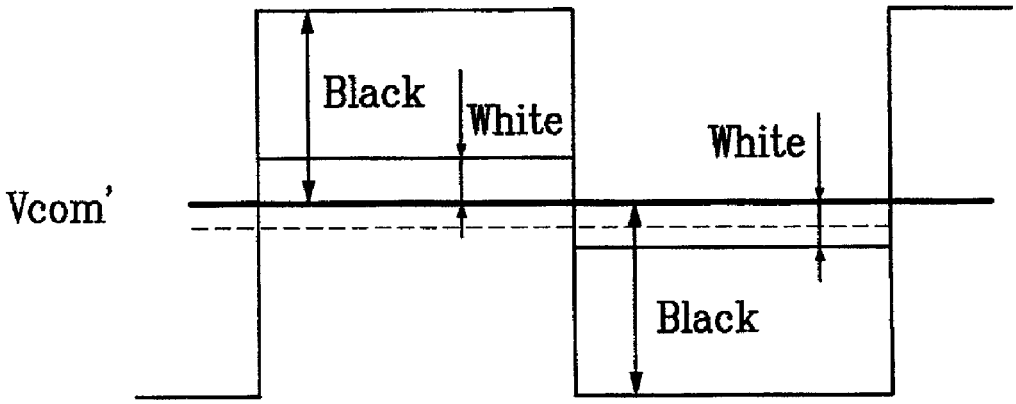

FIGS. 5A and 5B illustrate a signal diagram of a driving voltage range in an exemplary liquid crystal display according to the present invention. In FIG. 5A, as a low power voltage $V_{DD}$ is applied, a swing gap increases, as shown in FIG. 5B, when the power voltage $V_{DD}$ increases. Therefore, the common voltage should be adjusted from $V_{COM}$ to $V_{COM}$' in accordance with a corresponding amount of increase. Accordingly, two $V_{COM}$ output terminals may be required.

Figure 6:
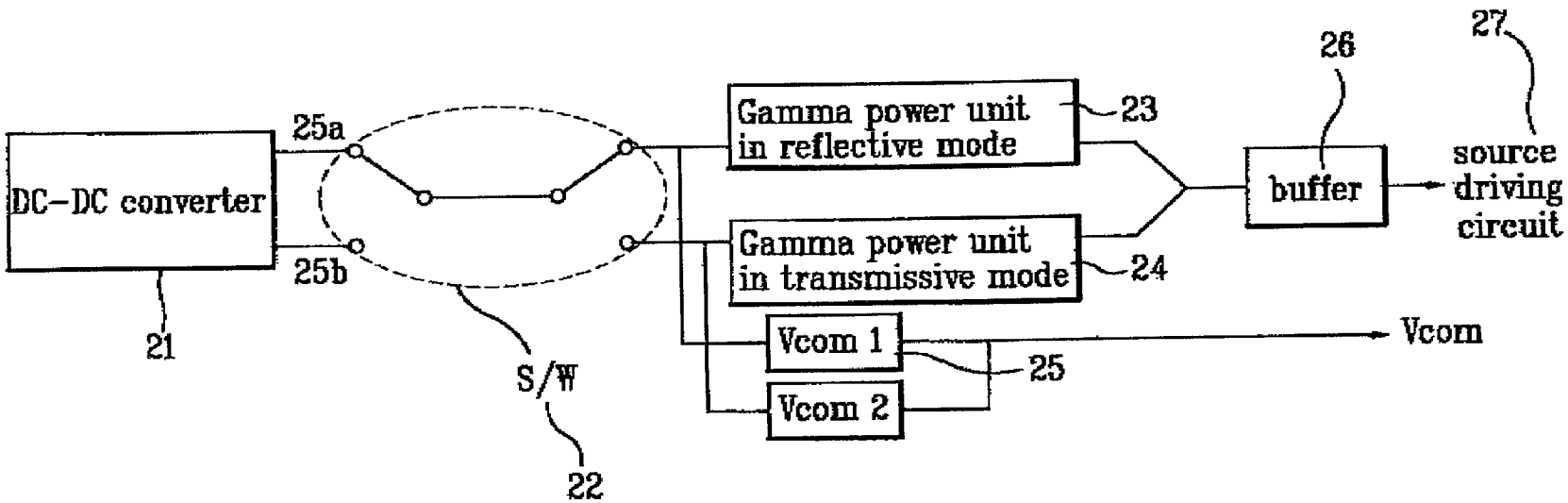
FIG. 6 illustrates another exemplary gamma reference voltage generating circuit of a liquid crystal display according to the present invention.

FIG. 6 illustrates another exemplary gamma reference voltage generating circuit of a liquid crystal display according to the present invention. In FIG. 6, the gamma reference voltage generating circuit may include a DC/DC converter 21 generating various voltages ($V_{DD1}$, $V_{DD2}$, $V_{GH}$, $V_{GL}$, and $V_{REF}$) applied in a liquid crystal display by using a voltage input from a driving system, a switching unit 22 selecting either a first power voltage $V_{DD1}$ or a second power voltage $V_{DD2}$ diverged from the DC/DC converter 21, first and second common power units 25*a* and 25*b* each providing a different common voltage to the liquid crystal display panel in accordance with the voltage output from the switching unit 22, first and second gamma power units 23 and 24 each outputting a gamma voltage corresponding to either a reflective mode or a transmissive mode to a digital/analog converter of a source driving circuit in accordance with the voltage output from the switching unit 22, a buffer 26 buffering a reference voltage generated from the first and the second gamma power units 23 and 24 and outputting the buffered voltage to the source driving circuit, and a source driving circuit 27 whereby the buffered reference voltage is applied.

In the gamma reference voltage generating circuit of FIG. 6, a stable gamma reference voltage may be generated even though the driving voltage ranges of the reflective mode and the transmissive mode are different. Due to the difference in driving voltage range between the reflective mode and the transmissive mode, the DC/DC converter may use a voltage diverged from a liquid crystal module of the driving system to generate the first power voltage $V_{DD1}$ and the second power voltage $V_{DD2}$. Additionally, the switching unit 22 applies the first and the second power voltages $V_{DD1}$ and $V_{DD2}$ to the first or the second gamma power unit 23 or 24, and simultaneously applies the two power voltages to the first and the second common power units 25*a* and 25*b* in accordance with the reflective mode and the transmissive mode. The signals may be synchronized with the ON/OFF switch of the backlight source. Therefore, in the reflective mode, the switching unit 22 simultaneously applies the first power voltage $V_{DD1}$ to the first gamma voltage unit 23 and to the first common voltage unit 25*a*. In the transmissive mode, the switching unit 22 simultaneously applies the second power voltage $V_{DD2}$ to the second gamma power unit 24 and to the second common power voltage unit 25*b*.

Each of the first and the second gamma power units 23 and 24 may apply a different gamma reference voltage to the source driving circuit according to the corresponding driving mode. Each of the first and the second common power units $V_{COM1}$ and $V_{COM2}$ may also input a different power $V_{DD1}$ or $V_{DD2}$. Therefore, according to the selection of power $V_{DD1}$ or $V_{DD2}$, the common power $V_{COM1}$, or $V_{COM2}$ may be selected without any additional switches.

Reference voltage generated from the gamma power unit passes through the buffer to be outputted to the digital/analog converter.

It will be apparent to those skilled in the art than various modifications and variations can be made the gamma reference voltage generating circuit of the present invention without departing from the spirit or scope of the invention. Thus, it is intended that the present invention cover the modifications and variations of this invention provided they come within the scope of the appended claims and their equivalents.

What is claimed is:

1. A gamma reference voltage generating circuit in a liquid crystal display, comprising:

a DC/DC converter generating a first power voltage $V_{DD1}$ during a reflective driving mode and a second power voltage $V_{DD2}$ during a transmissive driving mode;

a switching unit selecting and outputting one of the first power voltage and the second power voltage;

a first gamma power unit inputting the first power voltage from the switching unit and outputting a first gamma power voltage;

a second gamma power unit inputting the second power voltage from the switching unit and outputting a second gamma power voltage;

a first common power unit inputting the first power voltage from the switching unit and outputting a first common voltage; and a second common power unit inputting the second power voltage from the switching unit and outputting a second common voltage.

2. The circuit according to claim 1, further comprising a buffer buffering the first and second gamma voltages output from the first and second gamma power units, and applying the buffered voltage to a source driving circuit.

3. A liquid crystal display device, comprising:

a liquid crystal display panel;

a source driving circuit connected to the liquid crystal display panel;

a gate driving circuit connected to the liquid crystal display panel;

a switching unit selecting one of a first voltage and a second voltage output from a power converter;

a first output unit receiving the first voltage and producing a first gamma voltage during a reflective driving mode of the liquid crystal display panel;

a first common power unit receiving the first voltage and producing a first common voltage during the reflective driving mode of the liquid crystal display panel;

a second output unit receiving the second voltage and producing a second gamma voltage during a transmissive driving mode of the liquid crystal display panel;

a second common power unit receiving the second voltage and producing a second common voltage during the transmissive driving mode of the liquid crystal display panel; and a buffer buffering one of the first and second gamma voltages output from the first and second output units, and outputting a buffered voltage to the source driving circuit.

4. The circuit according to claim 3, wherein the second voltage is different from the first voltage.

5. A method for generating a reference voltage for digital/analog conversion in a source driving circuit of a liquid crystal display device, comprising the steps of:

selecting one of first and second voltages from a power converter;

providing the first voltage received from a the power converter to a first power unit and a first common power unit during a reflective driving mode of the liquid crystal display device to generate a first gamma voltage and a first common voltage;

providing the second voltage received from the power converter to a second power unit and a second common power unit during a transmissive driving mode of the liquid crystal display to generate a second gamma voltage and a second common voltage; and providing one of the first gamma voltage and the second gamma voltage to the source driving circuit and one of the first common voltage and the second common voltage to a liquid crystal display panel.

6. The method according to claim 5, wherein the second voltage is different from the first voltage.

7. The method according to claim 5, further comprising buffering one of the first and second gamma voltages, and outputting a buffered voltage to the source driving circuit.

8. A gamma reference voltage generating circuit in a liquid crystal display, comprising:

a voltage source to generate a first voltage and a second voltage;

a switch to select and output one of the first and second voltages;

a first power unit to receive the first voltage and output a first common voltage and a first gamma voltage when the first voltage is selected by the switch; and a second power unit to receive the second voltage and output a second common voltage and a second gamma voltage when the second voltage is selected by the switch, wherein the switch selects the first voltage in a reflective driving mode of the liquid crystal display and selects the second voltage in a transmissive driving mode of the liquid crystal display.

9. The circuit according to claim 8, wherein the first power unit includes a first gamma power unit to receive the first voltage and output the first gamma voltage and a first common power unit to receive the first voltage and output the first common voltage when the first voltage is selected by the switch, and the second power unit includes a second gamma power unit to receive the second voltage and output the second gamma voltage and a second common power unit to receive the second voltage and output the second common voltage when the second voltage is selected by the switch.

10. The circuit according to claim 9, further comprising a buffer buffering one of the first and second gamma voltages and outputting the buffered voltage to a source driving circuit.

11. The circuit according to claim 8, wherein the voltage source is a DC-to-DC converter.

12. The circuit according to claim 8, wherein the switch is synchronized with a backlight source of the liquid crystal display.

* * * * *